US005771829A

United States Patent [19]

Schebler et al.

[11] Patent Number: 5,771,829

[45] Date of Patent: Jun. 30, 1998

[54] METHOD AND APPARATUS FOR SHIRRING A FABRIC

[75] Inventors: Wilbur Schebler, Batesville; Louis H. Werner, Sunman; Dale J. Enneking, Batesville, all of Ind.

[73] Assignee: Batesville Casket Company, Inc., Batesville, Ind.

[21] Appl. No.: 366,837

[22] Filed: Dec. 30, 1994

[51] Int. Cl.[6] ..... D05B 35/08

[52] U.S. Cl. ..... 112/475.04; 112/132; 112/470.05

[58] Field of Search ..... 112/132, 135, 112/133, 134, 470.01, 470.02, 470.06, 470.32, 312, 313, 320, 475.04, 475.05, 163, 166, 144, 146

[56] References Cited

U.S. PATENT DOCUMENTS

| | | | |
|---|---|---|---|
| 957,159 | 5/1910 | Heiser . | |
| 1,468,483 | 9/1923 | Loomis . | |
| 2,318,497 | 5/1943 | Kassel . | |
| 2,495,130 | 1/1950 | Pilliner . | |
| 3,000,332 | 9/1961 | Sigoda | 112/132 |
| 3,018,744 | 1/1962 | Hacklander | 112/132 |
| 3,333,559 | 8/1967 | Benz . | |
| 3,608,507 | 9/1971 | Cima et al. . | |
| 3,633,526 | 1/1972 | Fay . | |
| 3,633,800 | 1/1972 | Wallace . | |
| 3,690,273 | 9/1972 | Reich . | |
| 3,728,978 | 4/1973 | Honda et al. . | |
| 3,804,688 | 4/1974 | Hillenbrand et al. . | |
| 3,824,964 | 7/1974 | Ryan . | |
| 3,893,402 | 7/1975 | Boser . | |
| 3,994,246 | 11/1976 | Boser . | |
| 4,073,246 | 2/1978 | Crawford et al. . | |
| 4,103,562 | 8/1978 | Boser . | |
| 4,280,425 | 7/1981 | Croyle . | |
| 4,466,367 | 8/1984 | Price et al. . | |
| 4,599,958 | 7/1986 | Stiers . | |
| 4,619,211 | 10/1986 | Semon et al. . | |
| 4,817,546 | 4/1989 | Yokoyama et al. | 112/470.05 |
| 5,031,554 | 7/1991 | Glenn . | |
| 5,080,267 | 1/1992 | Yogo . | |
| 5,094,180 | 3/1992 | Salganik . | |
| 5,156,104 | 10/1992 | Wada . | |
| 5,211,120 | 5/1993 | de Oliveira . | |
| 5,355,816 | 10/1994 | Echevarria . | |

*Primary Examiner*—Peter Nerbun
*Attorney, Agent, or Firm*—Wood, Herron & Evans

[57] ABSTRACT

A shirring attachment for a sewing machine that includes a programmable control operable to independently control the operation of individual shirring tools that are located at different points across the width of the material to be shirred. The shirring control stores a plurality of different shirring pattern programs some of which represent shirring patterns that vary across the width of the shirring material. Consequently, a number of shirring patterns can be produced that were not previously possible. Further, the shirring attachment is designed for a high production environment in which sewing machines operate at up to 1,000 stitches per minute.

22 Claims, 6 Drawing Sheets

METHOD AND APPARATUS FOR SHIRRING A FABRIC

FIELD OF THE INVENTION

This invention relates generally to a machine for shirring a fabric material, and more particularly, to a method and apparatus for programmably coordinating the operation of shirring tools with the operation of associated sewing needles both of which are disposed across the width of a fabric.

BACKGROUND OF THE INVENTION

For purposes of this application, shirring refers to a method or apparatus for producing a decorative pattern of a fabric by gathering the fabric. To produce a shirring pattern over a width of the fabric, sewing needles and shirring tools are disposed across the width of the fabric, and therefore, a decorative pattern is produced by shirring, that is, gathering the fabric at selected points across the width of the fabric. One application requiring shirring is the manufacture of a fabric liner that is used to provide decorative panels in burial caskets. It is important that such a liner present a high quality pleasing appearance. In years past, such liners were hand made. However, shirring and sewing by hand is tedious and difficult work that is very labor intensive and expensive.

In order to reduce the labor content in the manufacture of shirred liners, the Hillenbrand, et al. U.S. Pat. No. 3,804,688 issued to the assignee of the present invention discloses a shirring machine which gathers a decorative material along parallel rows and adheres or bonds that material to a backing material. In the Semon, et al. U.S. Pat. No. 4,619,211, a shirring machine is disclosed which has rollers with either flexible bristles, or mechanical fingers, that are mounted on a common spindle for gathering a decorative fabric in parallel rows. The rotation of the spindle containing the rollers is synchronized with the operation of the sewing needles which attach the gathered decorative fabric to a base material.

The Price, et al. U.S. Pat. No. 4,466,367 discloses a shirring feed roller that is rotated by a needle drive belt and is effective to shirr a decorative material moving over a plate and thereafter onto a base material. A sewing needle is operative to sew the shirred, that is gathered, decorative material onto the base material.

A more recent shirring machine design is known which has a plurality of shirring tools mounted adjacent a plurality of needles. A programmable logic control ("PLC") is programmed to be responsive to a predetermined number of stitching cycles of the reciprocating needle to operate a plurality of solenoids, each being connected to one of the shirring tools. As the material is fed through the sewing machine, the solenoids are operated simultaneously to perform a shirring cycle which gathers, or shirrs, the material across its width. Thereafter, the shirred or gathered material is sewn to a backing material by the reciprocating needles. The PLC can be programmed to count different numbers of stitches between shirring cycles, thereby varying the location of the shirring pattern over the material length. Further, the PLC is operative with the shirring tool solenoids to vary the stroke of the solenoid thereby varying the amount of material gathered by the shirring tools.

While the above shirring machines provide automation for manufacturing a gathered, decorative material pattern, those machines still have certain disadvantages. For example, referring to the '688 Hillenbrand patent, that shirring machine has component parts which are designed to produce a single shirring pattern. Theoretically, it is possible to use different rollers on the shirring machine of the '688 Hillenbrand patent to produce a different shirring pattern. Similarly, theoretically, different rollers having different numbers of fingers of different lengths may be utilized with the machine of the '211 Semon, et al. patent to produce a different shirring pattern. However, as a practical matter, modifying those machine designs to produce different patterns requires extensive experimentation as well as substantial time consuming and expensive modifications to the respective shirring machines. Therefore, typically such a shirring machine is manufactured, set up and run to produce a single shirring pattern. If a different shirring pattern is desired, a separate shirring machine is manufactured at the cost of hundreds of thousands of dollars.

A second related disadvantage to the fixed operation of the prior art shirring machines is that the individual shirring tools are not subject to independent control; and therefore, the shirring pattern is not subject to change or variation in real time during the operation of shirring machine. Consequently, more complex shirring patterns cannot be produced.

SUMMARY OF THE INVENTION

To overcome the disadvantages described above and to provide a more flexible shirring machine and control system with capabilities not previously found, the present invention provides a single machine that is capable of producing a plurality of different shirring patterns. Further, the shirring patterns produced by the shirring machine of the present invention may be programmably changed in real time to provide a variation of shirring patterns across the width of the fabric. Further, the shirring machine of the present invention is capable of a reliable high rate of operation that matches the sewing speeds of contemporary, industrial sewing machines. The present invention provides a shirring machine having significant versatility with the capability of producing a wide variety of shirring patterns on the same shirring machine at high production rates thereby providing a significant efficiency and cost benefit.

According to the principles of the present invention and in accordance with the described embodiments, a shirring attachment for a sewing machine includes a plurality of shirring tools disposed adjacent to reciprocating sewing needles and above a shirring fabric being fed through the sewing machine. Each of the shirring tools has an independent actuator that is programmably controlled to operate the shirring tool in synchronization with the reciprocating needles. A programmable shirring control stores programs of shirring patterns which are effective to operate selected shirring tool actuators as a function of the reciprocating cycles of the needles. Each shirring pattern program may be selected either manually or automatically as circumstances and production requirements dictate.

In a further embodiment of the invention, each of the actuators of the shirring tools is individually controllable by the programmable control in response to the stored programs. Consequently, the operation of the shirring tool actuators may be varied with the detected reciprocating cycles of the sewing needles thereby varying the shirring pattern across the width of the fabric as the shirring material is fed through the sewing machine. Consequently, the shirring machine of the present invention has the advantage of providing a greater variety of decorative and pleasing shirring patterns than was heretofore possible.

In a further aspect of the invention, the shirring tool actuators are mounted on a common bar or rack extending across the width of the sewing machine that is rotatable about a longitudinal axis of the mounting rack. Given that the shirring tool actuators have fixed length stroke, varying the angle of attack of the shirring tool with respect to the shirring fabric moving beneath the shirring tool causes the shirring tool contacting the fabric at different points with respect to the location of the needle. Consequently, the shirring stroke, that is, the horizontal displacement of the shirring tools, changes with different angles of attack; and different amounts of material are gathered in the shirring pattern. Therefore, the pivoting action of the actuator mounting rack has the advantage of providing an easy and inexpensive mechanism for adjusting the magnitude or size of the gather of the fabric, and the texture and appearance of the shirring pattern.

In a further embodiment, the distance of actuator mounting rack from the sewing needles is adjustable. Consequently, the actuator mounting rack includes a simple, inexpensive mechanism for quickly adjusting the position of the shirring tools and the terminal point of their shirring stroke with respect to the location at which the sewing needle penetrates the fabric.

In a still further embodiment of the invention, the shirring tool actuators include double-acting pneumatic cylinders that have an internal bore of a noncircular cross section into which a piston having the same noncircular cross section is slidably disposed. One end of the piston is connected to the shirring tool; and consequently, the noncircular cross section of the piston prevents the piston, and hence, the shirring tool from rotating during the shirring operation. Consequently, that aspect of the invention has the advantage of providing a reliable operation of the shirring tool over extended periods and at maximum operating speeds.

In a further aspect of the invention, operating valves are mounted directly on the shirring tool actuators; and therefore, the shirring tools are capable of high rates of operation to match the higher speeds of contemporary sewing machines, for example 1,000 stitches per minute. Therefore, the shirring tool of the present invention has the advantage of shirring material in greater quantities and in less time than previously known devices.

These and other objects and advantages of the present invention will become more readily apparent during the following detailed description in conjunction with the drawings herein.

DETAILED DESCRIPTION OF THE INVENTION

Figure 1:
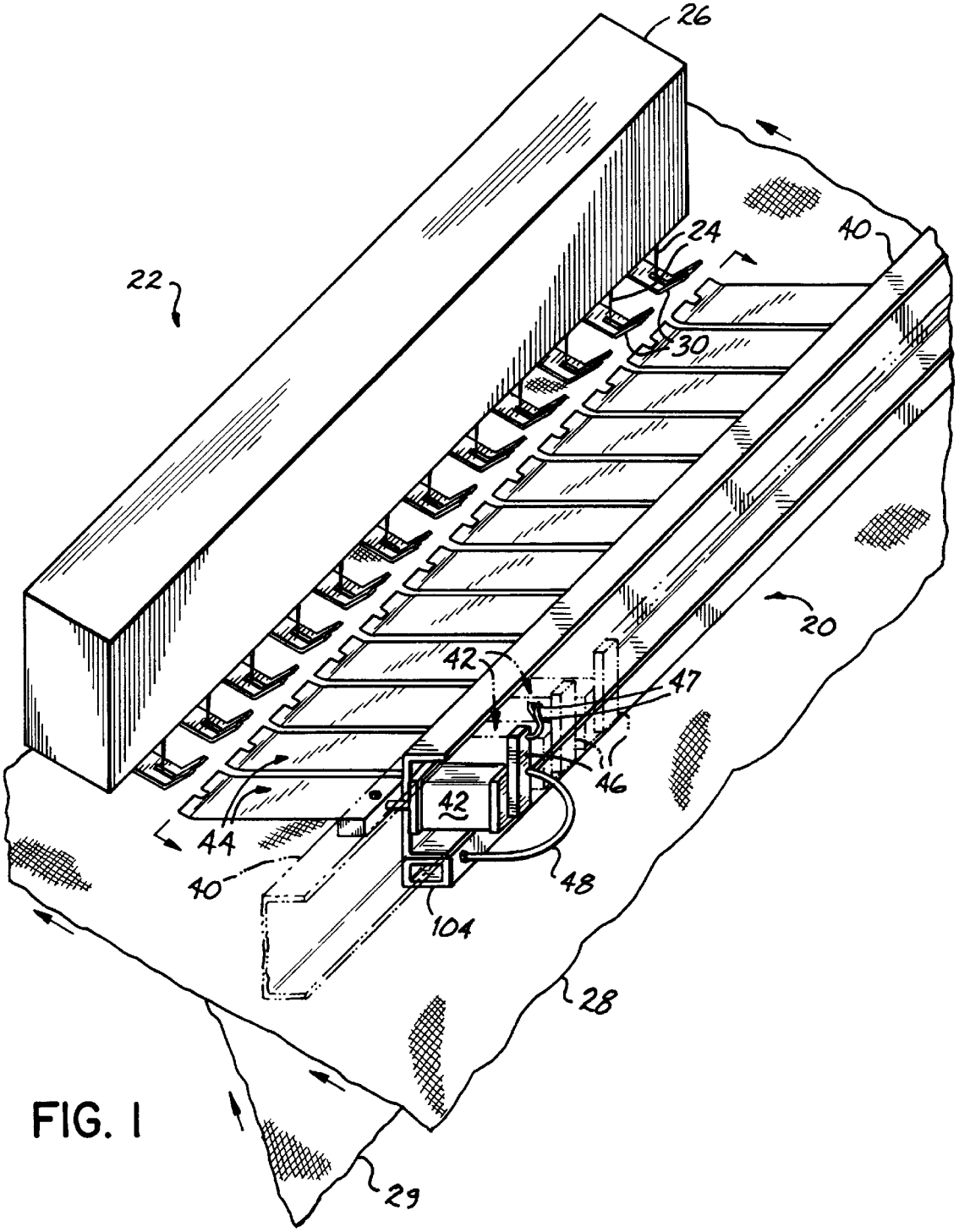
FIG. 1 is a partial perspective view of a sewing machine with the shirring tools of the present invention.

The shirring attachment 20 of the present invention is mounted on an industrial sewing machine 22. Typically, the sewing machine will have a plurality of reciprocating needles 24 which are moved in unison in a reciprocating sewing cycle by a common drive contained within a sewing head 26. The reciprocating needles 24 pass sewing threads (not shown) through shirring material 28 and backing material 29 which are held in a desired position with respect to each of the reciprocating needles 24 by a respective foot 30 located adjacent each of the needles. The multi-needle sewing machine 22 may be any one of a variety of commercial machines, for example, Model CWF-360 sewing machine from B&W Manufacturing of Brooklyn, N.Y.

The shirring attachment 20 is mounted on the sewing machine 22 and is comprised of a shirring bar 40 on which are mounted a plurality of double-acting shirring cylinders 42. The double-acting shirring cylinders 42 each have a solenoid valve 46 which operates in response to a control signal on line 47 to provide pressurized air from hose 48 to one end or the other of the double-acting shirring cylinders 42. The pressurized air moves a piston within the double-acting shirring cylinders 42 in one direction or the other thereby moving the shirring toes 44 either toward or away from the reciprocating needles 24. One cycle of the shirring toes 44 is effective to gather shirring material 28 over the backing material 29 which is then sewn together by the reciprocating needles 24. The double-acting shirring cylinders 42 may be any type of cylinder that can physically fit in the space permitted and move the shirring toes 44 in a shirring cycle at a frequency that matches the maximum desired stitching speed of the sewing machine 22. For example, if the sewing head 26 is operating the reciprocating needles 24 at 1,000 revolutions per minute ("RPM"), preferably, the highest frequency of operation of the shirring toes 44 is 500 shirrs per minute. Since the shirring toes 44 must be able to physically gather the material between the cycles of operation of the sewing needles 24, the frequency of operation of the shirring toes 44 must be slower than the rate of operation of the sewing needles 24 so that as the material 28 moves through the sewing machine 22, a portion of that material 28 is presented to the shirring toes 44 for gathering or shirring purposes. The relationship between the frequency of operation of the shirring toes 44 and the reciprocal stitching cycle of the needles 24 is determined by the shirring pattern that is being produced.

Figure 2:
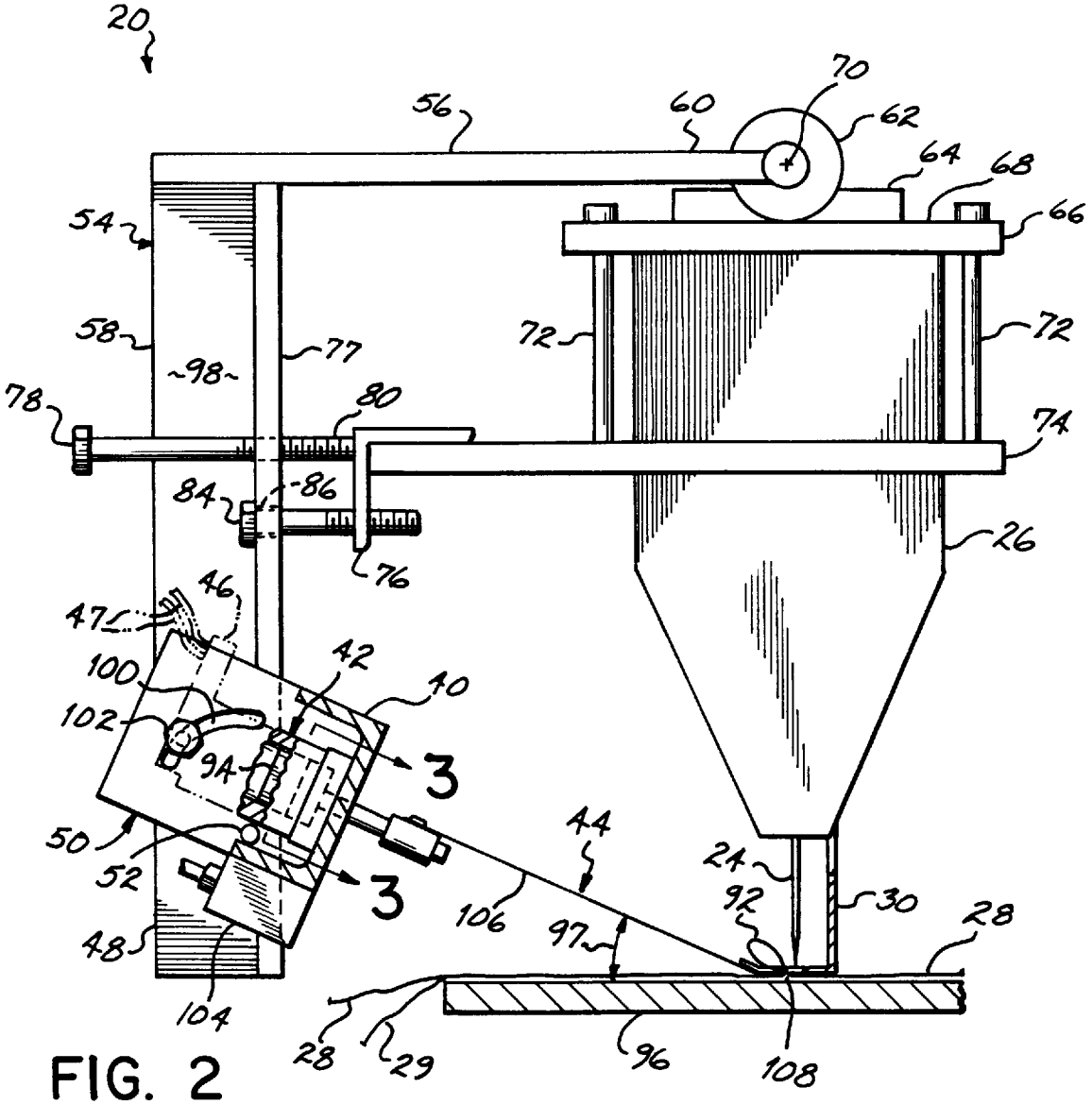
FIG. 2 is a schematic end view of the sewing machine illustrating how the shirring bar is adjustable with respect to the sewing machine.

FIG. 2 illustrates how the ends of the shirring attachment 20 are mounted on the sewing machine 22. The construction at each end of the shirring attachment 20, with respect to the shirring bar 40 is the same. The shirring bar 40 is connected at each end to an adjusting block 50. The adjusting block 50 is pivotally mounted on a pivot pin 52 connected to an L-shaped end support bracket 54. The end support bracket 54 has a generally horizontal upper arm 56 which is connected at one end to a generally vertical lower arm 58. The other end 60 of the upper arm 56 is rotatably connected to a bearing 62. The bearing 62 is attached to a support block 64 which rests on a generally horizontal upper connecting plate 66. As the support block 64 slides on an upper surface 68 of the upper connecting plate 66, the end support bracket 54 is able to move in a generally horizontal direction to the left and to the right as viewed in FIG. 2. Further, the end support bracket 54 is able to rotate with respect to an axis of rotation 70 which is effective to pivot the shirring bar 40 with respect to the sewing head 26. The pivoting action of the end support brackets 54 allows the shirring bar 40 to be pivoted up and out of the vicinity of the sewing needle 24 for purposes of observation, maintenance, etc. The upper connecting plate 66 has bolts or other fasteners 72 which are threaded into a lower connecting plate 74. The upper and lower connecting plates 66, 74 effectively clamp one end of the shirring bar 40 to one end of the shirring attachment 20. An identical assembly of components including the components 50 to 74 is used to attach the other end of the shirring bar 40 to the other end of the sewing head 26.

The lower connecting plate 74 has a stop plate 76 attached to one end thereof. A first adjusting bolt 78 is threaded through the lower arm 58 of the L-shaped end support bracket 54 and has a flat end 80 that bears against the stop plate 76. Therefore, assuming the adjusting bolt 78 has a right-hand thread, a clockwise rotation of the adjusting bolt 78 is effective to move the end support bracket 54 and shirring bar 40 to the left as viewed in FIG. 2. A second adjusting bolt 84 extends through a clearance hole 86 in the lower arm 58 and is threaded through the stop plate 76. Assuming that the adjusting bolt 84 has right-hand threads, rotation of the adjusting bolt 84 in a clockwise direction is effective to move the end support bracket 54 and shirring bar 40 to the right as viewed in FIG. 2. An identical adjusting mechanism is at the other end of the shirring bar 40. Consequently, the adjusting bolts 78, 84 on the end support brackets 54 at each end of the sewing head 26 are used to precisely adjust the parallelism of the shirring bar 40 with respect to a line intersecting all of the needles 24.

The shirring toe 44 illustrated in FIG. 2 is shown in its fully advanced position in which it has gathered a material loop 92 of the shirring material 28 immediately adjacent the needle 24. The shirring toe 44 must be able to push the material loop 92 up to and just under the foot 30 so that the loop and material move together under the foot 30 as it is sewn, that is, stitched, by the reciprocating needle 24. It is important that the material loop 92 be secured by the foot 30 associated with the needle 24 so that as the shirring toe 44 retracts it does not pull the material loop 92 with it thereby undoing the gather or shirr which was formed when the shirring toe 44 was advanced. The sewing feet 30 are typically actuated by pneumatic cylinders (not shown) in the sewing head 26; and the holding pressure exerted by the sewing feet 30 is controlled by regulating the pneumatic pressure in those actuating cylinders. With the present invention, a lesser pressure may be used to hold the shirring loop, for example, a pressure in the range of 10–15 pounds per square inch (psi). The adjusting bolts 78, 84 on each of the end support brackets 54 permit the adjustment of the shirring bar 40 such that the shirring toes 44 are in their desired precise position when the shirring toes 44 are at the end point of their shirring stroke. That is, when the pistons 94 and the shirring toes 44 are in their advanced position which moves the shirring toes 44 to the right as illustrated in FIG. 2.

As illustrated in FIG. 2, the shirring toes 44 are positioned to have a predetermined angle of attack, that is, an angle 97 with respect to the table 96 of the sewing machine 22. The angle of attack is preferably approximately 24°. The lower arm 58 of the end support bracket 54 is an angled or L-shaped piece with one side 77 containing the adjusting bolts 78, 84. The other side 98 of the lower arm 58 is adjacent to and bears against one surface of the adjusting block 50. The adjusting block 50 contains an arcuate slot 100. A bolt, or other fastener, 102 extends through the second side 98 of the lower arm 58 and the arcuate slot 100 of the adjusting block 50. Consequently, when the bolt 102 is loosened, the adjusting blocks 50 at each end of the shirring bar 40 are free to pivot with respect to the pivot pins 52 thereby changing the angle of attack of the shirring toes 44. As can be seen in FIG. 2, the length of advance and retract strokes of the shirring toes 44 is constant and the direction of the shirring stroke is the hypotenuse of a triangle the lower side of which is coincident with the upper surface of the table 96. Therefore, by changing the magnitude angle of attack 97 of the shirring toes 44, the horizontal distance traveled across the top of the table 96 by the shirring toes 44 will change. By changing the horizontal distance traveled by the shirring toes 44 when they are advanced, the amount of material 28 gathered by the advancing shirring toes 44 will change, and, consequently, the size of the material loop, or gather, 92 with each shirring stroke can be adjusted.

Figure 3:
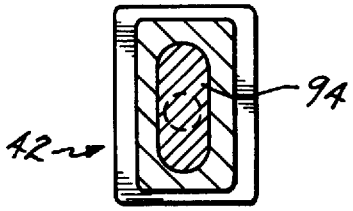
FIG. 3 is a cross-section taken along line 3—3 of FIG. 1.

It is important that as the shirring toes 44 advance in the shirring stroke that the toes remain flat against the upper surface of the table 96 so that the material 28 is moved evenly and the shirred material loop 92 is consistent in size and appearance across the width of the material 28. Therefore, the shirring toes 44 cannot experience any rotation during their operation. In order to maintain the desired parallelism between the width of the shirring toes 44 and the top of the table 96 of the sewing machine 22, the pistons 94 within the double-acting shirring cylinders 42 have a non-circular, and preferably an oval, cross-section as shown in FIG. 3. A double-acting cylinder of the type suitable for use with the present invention is the compact oval cylinder, valve-on-cap, OOD1R, 0.75×0.625, E4-F1-K3-U10 commercially available from Neff Engineering of Indianapolis, Ind. In order to improve and optimize the response time of the system, the solenoid valves 46 are attached directly to one end of the double-acting shirring cylinders 42. Preferably, solenoid valve 46 is a MAC Valve, 44A-AAA-DCA-1KA-Model No. 2484, commercially available from Neff Engineering of Indianapolis, Ind. To further provide the most uniform operation of all of the shirring cylinders 42 illustrated in FIG. 1, the air supply hoses 48 are of the same length and are connected to the same air manifold 104 which in turn is connected to a source of pressurized air. The air pressure to the manifold 104 is regulated and adjustable, and its specific magnitude will depend on the characteristics of the fabric being processed. For example, stiffer fabrics may require a higher shirring cylinder pressure and vice versa.

The shirring toes 44 must provide constant and uniform forces to the material 28 during the shirring cycles. The shirring toes 44 have a flexible blade portion 106 which is preferably made from a blue tempered spring steel, approximately 1.5 inches wide and 0.025 inches thick. The blade portion has one end connected to the piston rod and is curved at the other end to provide an area suitable for material contact. The other end includes a clearance notch 107 (FIG. 1) and is curved at the end. The other end of the blade 106 also has a pad 108 which contacts and grabs the material 28 during the shirring cycle. The pad 108 is preferably made from a conveyor belt type of material which provides a surface with a relatively high coefficient of friction.

Figure 4:
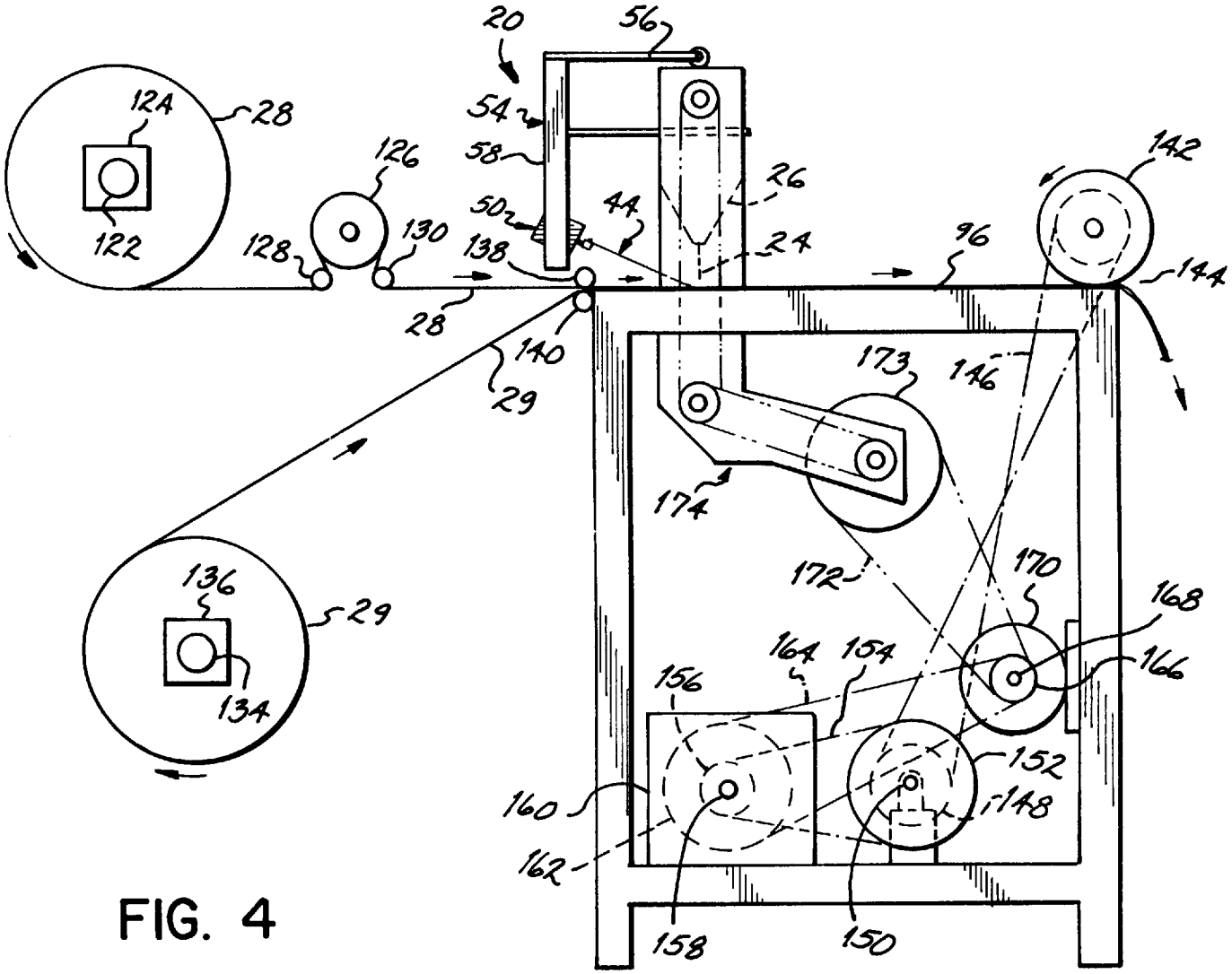
FIG. 4 is a schematic end view of the sewing machine illustrating the material drive and flow.

FIG. 4 illustrates the drive for the sewing machine 22 and the material 28. On a typical sewing machine, the material feed is provided by a feed dog (not shown) which operates in a generally circular motion beneath the sewing foot 30. The feed dog is designed to push the material against the lower surface of the foot 30 and move the material through incremental horizontal feed strokes. With the present invention, the position of the feed dog is adjusted so that it does not contact or feed material across the table 96 of the sewing machine 22. A roll of shirring material 28 is mounted on a first axle 122. A braking mechanism 124, for example, an adjustable electric brake, is utilized to provide a tension or drag force in a direction opposite the direction of material feed. The direction of material feed is to the right as viewed in FIG. 4. The material 28 then passes over a freely rotating spreader roller 126 that has guide rollers 128 and 130 mounted on each side of the spreader roller 126. A roll of backing material 29 having a width generally the same as the width of the shirring material 28 is mounted on a second axle 134. Again, an electrical brake 136 is used to provide a tensioning, or dragging, force in a direction opposite the direction of material feed. Guide rollers 138, 140 guide the shirring material 28 onto the table 96 of the sewing machine 22 such that the shirring material 28 lays on top of the backing material 29. The shirring material 28 and backing material 29 pass under the shirring attachment 20 which operates to provide a predetermined pattern of shirrs, or gathers, of the shirring material 28 over the backing material 29. That pattern of shirrs of the shirring material 28 is sewn into place on top of the backing material 29 by the reciprocating needles 24 thereby forming the desired shirred. The shirred liner passes as a unitary piece over the top of the table 96 and under pinch roller 142 located on the output side 144 of the sewing machine 22. The pinch roller 142 is adjustable to provide a generally vertical force in the downward direction against the table 96 to pinch the shirred liner material between the pinch roller 142 and the table 96. Consequently, the pinch roller 142 is effective to pull the shirring material 28 and backing material 29 off of their respective rolls and into the sewing machine 22 for the shirring and sewing operations.

The pinch roller 142 is connected by a first chain loop 146 which is also connected to a sprocket 148 on one end of an axle 150 extending from one side of the sewing machine 22 to the other. The other end of the axle 150 contains a sprocket 152 on which is mounted a chain loop 154 which is also wrapped around sprocket 156. The sprocket 156 is connected to a drive shaft 158 extending from a gear box 160. Also connected to the drive shaft 158 is a pulley 162 on which is mounted a belt 164 that is also wrapped around pulley 166. The pulley 166 is connected to an output drive shaft 168 of an electric motor 170. The electric motor 170 also drives belt 172 from pulley 166, and belt 172 is connected to a drive pulley 173 which provides power to a sewing head drive mechanism 174 which is operative to operate the needles 24 in their reciprocating sewing cycle.

The drive mechanism illustrated in FIG. 4 is effective to synchronize the operation of the sewing head 26 with respect to the feed of the material 28. From the electric motor 170, the drive pulley 173 provides a rotational drive to the sewing head drive mechanism 174 so that the sewing head 26 operates at a desired rate of speed, that is, at the desired number of stitches per minute. That desired rate of speed is adjustable by the operator changing the operating speed of the electric motor 170. Similarly, by means of the gear box 160 which may, for example, provide a 50:1 speed reduction, the pinch roller 142 pulls the material 28 through the sewing machine 22 in synchronization with the operation of the sewing head 26. Further, as the operator increases the speed of the sewing head 26 by increasing the speed of the electric motor 170, the speed of the pinch roller 142 is likewise increased thereby increasing the speed of the materials 28, 29 being fed into the sewing machine 22.

Figure 5:
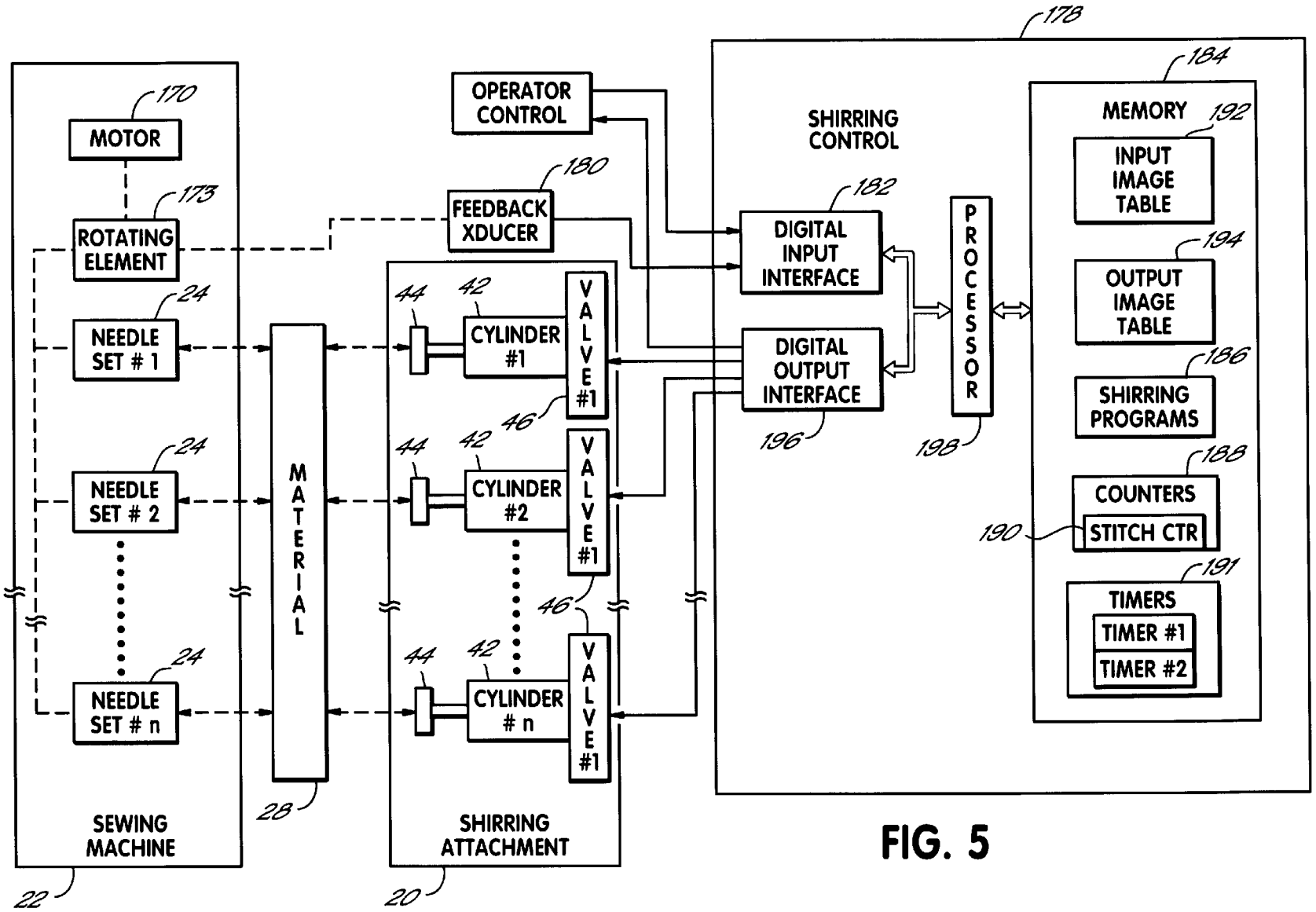
FIG. 5 is a schematic block diagram of the shirring control of the present invention.

FIG. 5 is a schematic block diagram of the shirring control which is operative to individually control the operation of the double-acting shirring cylinders 42 thereby individually controlling the operation of shirring toes 44. The shirring control 178 is synchronized with the operation of the electric motor 170 by means of a feedback transducer 180 which is sensitive to the rotation of the drive pulley 173. The feedback transducer 180 may be implemented by an encoder device which produces an output pulse or feedback signal in response to each rotation of the drive pulley 173. The shirring control 178, which preferably is implemented using an Allen Bradley PLC5 Control commercially available from Allen Bradley, Milwaukee, Wis., receives the feedback signal through a digital input interface 182. The shirring control 178 includes a memory 184 within which is stored a plurality of shirring programs 186. As will be described in more detail, the shirring programs 186 define the operation of each of the shirring toes 44 in response to and as a function of a number of stitches as represented by rotations of the drive pulley 173. For example, each 360° rotation of the drive pulley 173 is effective to move the needles 24 through one complete reciprocation corresponding to the sewing of one stitch. Therefore, the shirring programs 186 are effective to command operation of the various double-acting shirring cylinders 42 thereby operating respective shirring toes 44 to produce the desired shirring pattern on the material 28.

The memory 184 further contains the counters 188, one of which is a stitch counter 190 that increments one count in response to receiving a feedback signal from the feedback transducer 180. In addition, the memory 184 contains timers 191 which are operative to maintain output signals from the shirring control 178 to the individual solenoid valves 46 that operate the double-acting shirring cylinders 42. Memory 184 also has an input image table 192 which is a number of 16 bit words, each bit having a state corresponding to the state of one of 16 input signals on a digital input interface board within the digital input interface 182. Similarly, the memory 184 contains an output image table 194 which has a number of 16 bit words each bit having a state corresponding to the desired state of one of 16 output lines contained on each digital output interface board in the digital output interface 196. The processor 198 of the shirring control 178 continuously executes a cycle of operation by which the states of the inputs to the digital input interface 182 are read and updated to the input image table 192. The currently active shirring program within the memory 184 is executed and if a change in outputs is required, the signal states in the output image table 194 are updated. The output states on output lines from the digital output interface 196 are thereby changed to modify the operation of the solenoid valves 46, the double-acting shirring cylinders 42, and the shirring toes 44.

Figure 6:
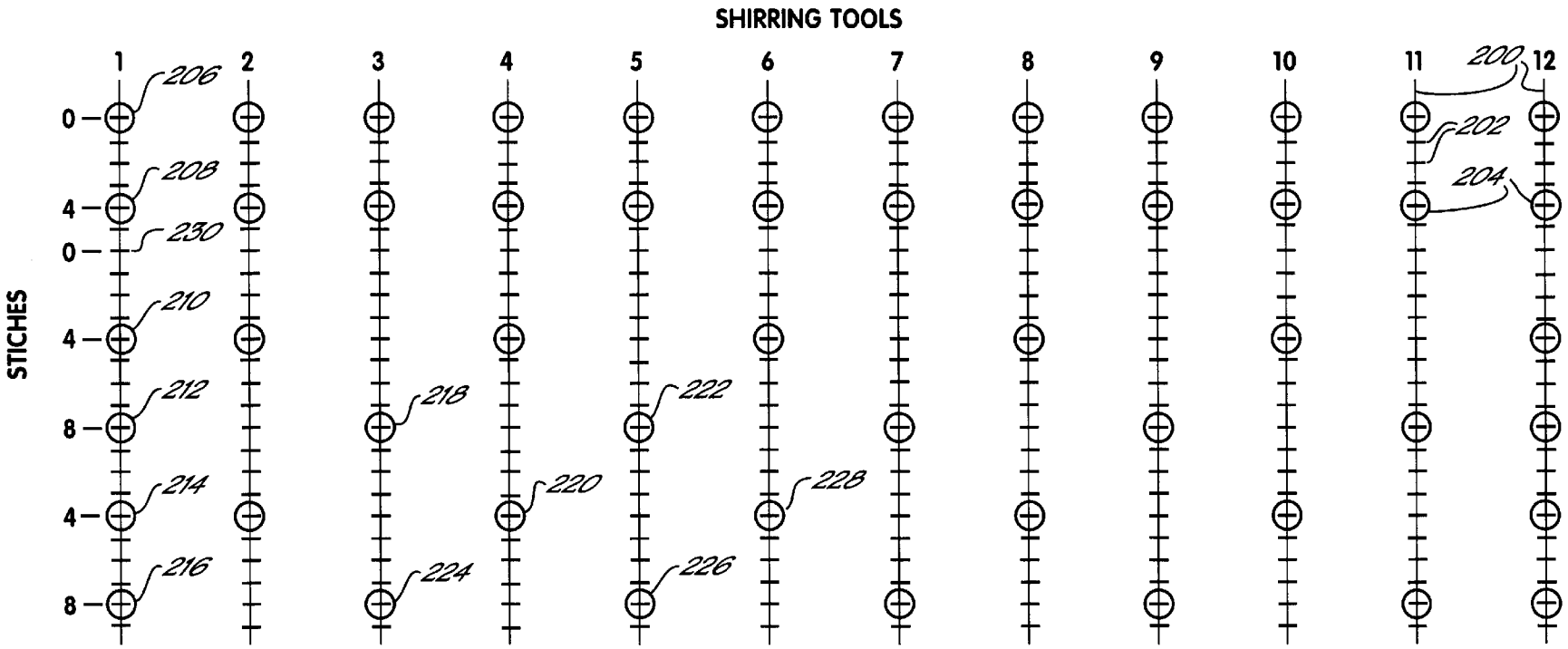
FIG. 6 is a stitch diagram schematically illustrating a desired shirring pattern.

In use, the desired shirring pattern must first be designed and, preferably, laid out in a manner that facilitates programming of a shirring cycle. That design may be accomplished by using a stitch diagram, such as that shown in FIG. 6. Each of the vertical lines 200 of FIG. 6 are associated with one of the shirring tools. Each shirring tool is associated with one or more of the sewing needles 24. Each horizontal crossbar 202 represents a sewing stitch, and each sewing stitch is numbered in the vertically downward direction. The circles 204 represent a shirring cycle of an associated shirring tool and define a point in the pattern in which the shirring material 28 is gathered. The relative locations of shirring cycles across the width of the material will define a geometric pattern of gathered material which presents a unique appearance. For example, with the prior art shirring machines, all of the shirring tools are operated in unison; and, therefore, at predetermined stitches representing incremental material lengths, shirring cycles represented by circles on every vertical line are executed by each shirring tool, such as shown at stitch rows 206 and 208. The resulting shirring pattern is simply two straight lines of gathered material extending across the material width. With the capability of the present invention of individually controlling the shirring tools, more complex shirring patterns can be manufactured. For example, at stitch row 210, shirring tools 1, 2, 4, 6, 8, 10 and 12 can be programmed, or commanded to execute a shirring cycle. At stitch row 212, which occurs four stitches after stitch row 210, shirring tools 1, 3, 5, 7, 9, 11 and 12 can be programmed, or commanded to execute a shirring cycle. That shirring pattern is repeated as illustrated at stitch rows 214 and 216. Consequently, the material can be gathered or shirred at different points across the width of the material; and a more complex geometric pattern is created. For example, the gathers at stitches 218, 220, 222, 224, 226 are visually perceived as a bow pattern. Alternatively, gathers at stitch points 220, 222, 226, 228 appear as a diamond pattern. The geometric patterns may be contracted or expanded to encompass different numbers of stitches as a function of the workability of the shirring material and what is perceived to be pleasing in appearance.

After the desired shirring pattern diagram is created, for example, the shirring patterns defined in stitch rows 210–214 of FIG. 6, that shirring pattern is transformed into a set of instructions or a program which is stored in the shirring program memory section in the memory of the control. With the control previously referenced, the digital output interface 196 includes one or more interface boards which are plugged into the control. Each board has the capability of providing 16 binary output signals. The state of each of those 16 binary output signals is defined by the state of a corresponding bit of a 16 bit binary output word stored in an output image table 194 in the memory 184. In the present example, the operative states of the 12 shirring tools are controlled by the states of 12 corresponding bits of a 16 bit output word stored in the output image table 194.

Therefore, the shirring pattern of FIG. 6 is executed by writing different output words to the output image table 194 that correspond to the desired operational state of the shirring tools. For example, referring to stitch row 230, which is the starting row for the first stitch pattern executed at stitch row 210, all of the shirring tools are maintained in an OFF, or a retract tool, state. Therefore, a first output word is defined representing the retracted state of each of the shirring tools and cylinders. Referring to stitch rows 210, 214, a second output word is defined in which the shirring cylinders 1, 2, 4, 6, 8, 10 and 12 are switched to an ON, or an advance tool, state. Similarly, referring to stitch rows 212, 216, a third output word is defined in which shirring cylinders 1, 3, 5, 7, 9, 11 and 12 are switched to their ON, or advance tool, state. Further, the shirring pattern is defined in terms of its repeat pattern. For example, if stitch row 230 represents the start of the shirring pattern, three stitches are made by the sewing machine 22 with no shirring activity. On the fourth stitch represented by stitch row 210, the second output word is loaded into the output image table 194 which causes the digital output interface 196 to provide the appropriate output signals to advance and retract the tools of the shirring cylinders 1, 2, 4, 6, 8, 10 and 12. During the next three stitches, there is no shirring cycle activity. However, on the eighth stitch from the start of the shirring pattern represented by stitch row 212, the shirring pattern requires that the third output word be loaded in the output image table 194 to cause the digital output interface 196 to provide output signals to advance and retract the shirring tools 1, 3, 5, 7, 9, 11 and 12. Thereafter, the shirring pattern starting with stitch row 230 and ending with stitch row 212 is repeated and ends at stitch row 216; and the shirring pattern is continuously repeated for successive groups of eight stitches. Therefore, any shirring pattern can be defined in terms of different output words representing the advance and retraction of the shirring tools and cylinders in association with a stitch count within the shirring pattern. That process and shirring pattern is then repeated as the material 28 advances through the sewing machine 22.

Using a diagram similar to FIG. 6 or some other tool, various shirring programs are created and loaded in the shirring program section of the memory 184. Each of the shirring programs has a name, or a number or other identifying address; and individual programs are selected by an operator, for example, by using a selector switch on the control panel. Alternatively, if production quantities are known in terms of a lineal measurement, for example, the number of yards of material to be shirred with each shirring pattern, the shirring programs may be automatically selected using a feedback device from the sewing machine 22 which measures the length of material 28 passing through the sewing machine 22. As programmed lengths of material 28 are detected as passing through the sewing machine 22, different shirring pattern programs may be automatically selected.

Figure 7:
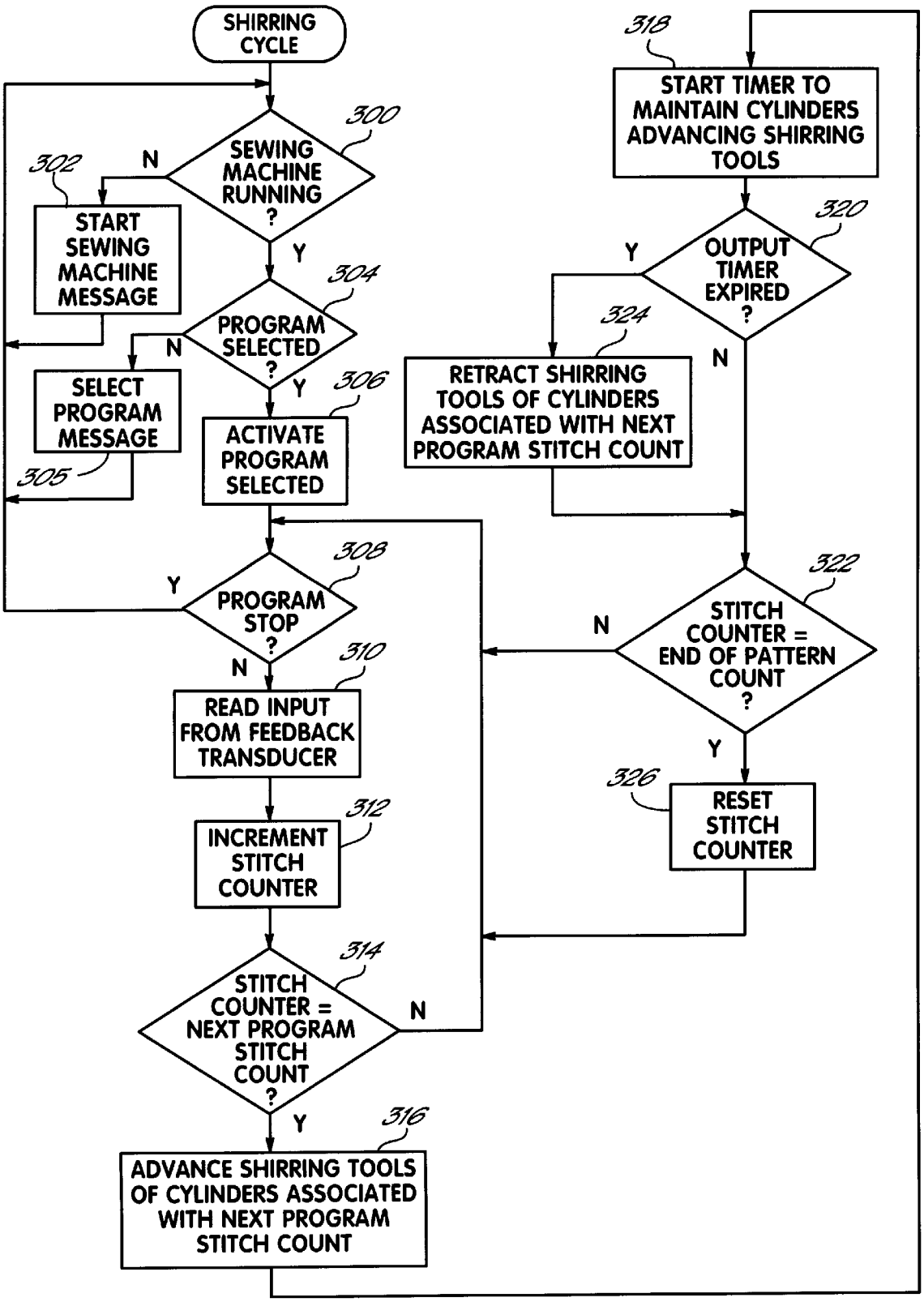
FIG. 7 is a flowchart illustrating the process steps of a shirring cycle of the present invention.

FIG. 7 illustrates a flowchart of a process for executing a shirring cycle in response to the previously described program. As part of a general power-on and initialization process, the control will load output words in the output image table 194 that have default values which represent outputs from the digital output interface 196 to activate the valves such that the cylinders 42 maintain the shirring tools 44 in their retracted positions. The shirring cycle program of FIG. 7, if activated, is executed with each scan, or cycle of execution of active programs, by the processor within the control. Each scan or cycle may occur, for example, every 2–4 milliseconds. During that period of time, the processor will execute as much of the shirring cycle program of FIG. 7 as process conditions permit. The shirring cycle may be started either manually or automatically. The process first, at 300, determines whether the sewing machine 22 is running. If it isn't, a start sewing machine message is created at 302. The sewing machine 22 may be manually started or started by other automatic mechanisms outside the shirring cycle itself. In either event, the shirring cycle is inhibited from further activity until it detects that the sewing machine 22 is running at 300. After the sewing machine 22 is started, the shirring cycle process at 304 checks whether a shirring cycle program has been selected. If not, a select program message is created at 305; and again, the shirring cycle program may be manually selected or automatically selected by processes external to the shirring cycle process itself. When a program is detected as being selected, the shirring cycle program then activates that program at 306. Activation of a program is dependent on the type of control being used, but the essence of activation is to cause one of the stored shirring cycle programs to begin execution. Next, at 308 the process detects whether a program stop is active. A program stop may result from an operator input, a cycle error condition, or other detected machine condition which requires that the current shirring cycle be terminated. If the shirring cycle program detects a program stop condition or flag, it returns to the beginning of the program and will not proceed further until the program stop condition has been cleared.

If during a subsequent scan or cycle of the processor, the program stop condition is cleared, the sewing machine 22 is running, a shirring program is selected and activated, the process then at 310 reads an input from the feedback transducer 180. With each revolution of the rotating element, the feedback transducer 180 produces an output signal or pulse to the digital output interface 196 of the control. The state of that input signal is stored as part of an input word in the input image table 192. During the process at 310, the processor reads the states of the words in the input image table 192 and will determine whether the feedback transducer 180 has produced a pulse representing a full 360° rotation of the rotating element and hence a stitch of the sewing machine 22. If an input is detected, the shirring cycle process at 312 will increment a stitch counter which is included within the counter section of the memory 184. Next, the shirring cycle process at 314 determines whether the accumulated value in the stitch counter is equal to the next programmed stitch value.

Referring to FIG. 6, during stitch counts 1, 2 and 3 the shirring tools are maintained in their initialized retracted position. On the programmed stitch count 4, shirring tools 1, 2, 4, 6, 8, 10 and 12 are programmed to advance. Consequently, returning to FIG. 7, when the stitch counter counts 4 stitches, which is the next programmed stitch count, the process at 316 reads an output word turning on or activating the valves associated with the shirring tools 1, 2, 4, 6, 8, 10 and 12 and loads that output word into the output image table 194. The digital output interface 196 turns ON corresponding digital output signals to cause the valves to port pressurized air into the cylinders associated with shirring tools 1, 2, 4, 6, 8 10 and 12 to advance those tools, thereby gathering the shirring material 28 at first locations across its width in association with the programmed stitch count 4. Simultaneously, the shirring process at 318 starts timers in the timers section of the memory 184 of the control. To guarantee that the digital output interface 196 maintains a signal to the valves for the length of time required for the cylinders to advance the tools, a timer is used to maintain the signals in the ON state from the output image table 194 for the desired period of time. For example, preferably the timers are set to time a period of 100 milliseconds. The shirring cycle process at 320 detects whether the output timer has expired. If it has not, the shirring cycle process then detects at 322 whether the stitch counter is equal to the end of pattern stitch count. Referring to FIG. 6, the programmed stitch pattern repeats every eight stitch counts. Therefore, with that pattern, the end of pattern stitch count is equal to eight. Since the stitch counter is at 4, the process then returns to detect whether at 308 a program stop is active.

The processor in the control continues its repetitive scans and executes through steps 300–320 of the shirring cycle until it detects that the output timer at 320 has expired. The shirring cycle process then at 324 loads the first output word into the output image table 194 which is effective to turn the output signals OFF which operates the valves to port pressurized air to operate the cylinders to retract the shirring tools. Since only those shirring tools associated with the stitch count 4 are advanced, consequently, only those same shirring tools will be retracted. The shirring cycle program then returns again to check at 308 whether a program stop condition exists and continues to read the input from the feedback transducer 180 at 310. The stitch counter is incremented at 312 with each transducer input, and as the stitch counter counts stitches 5, 6 and 7, the shirring cycle program of FIG. 7 takes no further action. When the stitch counter counts stitch 8, which is the next programmed stitch count, the process at 316 loads the output word commanding shirring tools 1, 3, 5, 9, 11 and 12 to advance into the output image table 194 thereby causing the digital output interface 196 to turn ON the output signals to selected valves which ports pressurized air to cylinders to advance the shirring tools 1, 3, 5, 7, 9, 11 and 12. That action causes the shirring material 28 to be gathered at second locations across the width of the shirring material 28 by shirring tools 1, 3, 5, 7, 9, 11 and 12. The shirring tools 2, 4, 6, 8 and 10 are inactive, and the shirring material 28 passes under those tools with no gathering action.

As previously described, an output timer is started at 318. Preferably, a different output timer is used in association with the output signals operating the shirring tools at a different times in the execution of the shirring program. Different timers are used to minimize the potential for conflict and faults that may be caused by different response times and time delays within the control system. After checking whether the output timer is expired at 320, the shirring cycle process checks at 322 whether the stitch counter is equal to the end of pattern count.

The end of pattern count is that stitch count after which the shirring pattern begins the next repetition. In the present example, the shirring cycle program being executed has a shirring pattern of 8 stitches. Therefore, the stitch counter will detect an end of pattern stitch count at 322, and the process at 326 will reset the switch counter back to its zero state. Consequently, when the next input from the feedback transducer 180 is received, the stitch counter will be incremented to 1. As the shirring material 28 moves through the sewing machine 22, the shirring cycle process operates continuously to operate alternate shirring tools to provide a shirring pattern of staggered gathers. The process continues until an operator provides a stop command or the stop command is provided by some other condition which the shirring cycle process detects at 308.

While the invention has been set forth by a description of the embodiment in considerable detail, it is not intended to restrict or in any way limit the claims to such detail. Additional advantages and modifications will readily appear to those who are skilled in the art. For example, the feedback transducer 180 may be a transducer producing a single pulse with each revolution of the drive pulley 173, or may be an encoder producing a plurality of pulses, for example, 1,200 pulses per revolution of the drive pulley 173. The feedback transducer 180 may be mechanically coupled to the drive pulley 173 or may sense its rotation by means of infrared or LED detectors, or sense the rotation of the drive pulley 173 by magnetic proximity detection devices. The feedback transducer 180 may alternatively be connected to any other element within the drive mechanism illustrated in FIG. 4.

The timers 191 may also be used to finely tune the system to compensate for differences in the cycle times of the solenoid valves 46 and double-acting shirring cylinders 42. Therefore, the timers 191 may be used to adjust the precise time that each of the solenoid valves 46 are fired, that is, to slightly retard or advance the operation of the individual solenoid valves 46. Alternatively, timers 191 may be implemented within the process of FIG. 7 with respect to the operation of the stitch counter 312 to advance or delay the shirring cycle with respect to the reciprocating sewing cycles.

Although preferably a shirred material 28 is sewn onto a backing material, the apparatus of the invention may be used without the backing material 29 to shirr and sew gathered loops onto the shirring material 28 itself. Further, the belt and chain drives described with respect to FIG. 4 may be replaced by any comparable drive mechanism. Accordingly, departures may be made from the details described herein without departing from the spirit and scope of the invention.

What is claimed is:

1. A shirring device for use with a sewing machine having a plurality of sewing needles arranged across a width of the sewing machine, the plurality of sewing needles carrying thread and being moved through a reciprocating cycle by a needle drive to sew a fabric being moved at a feed velocity beneath the plurality of needles, the shirring device comprising:

a plurality of double acting fluid operated solenoids mounted at different locations across the width of the sewing machine, each of the fluid operated solenoids including a cylinder having a bore with a noncircular cross-section extending longitudinally between opposite ends of the cylinder, and a piston having a noncircular cross-section generally conforming to the noncircular cross-section of the cylinder, the piston being slidingly disposed within the cylinder; and a plurality of shirring tools each of which is connected to one end of a respective piston, the plurality of shirring tools selectively contacting and moving the fabric at a velocity greater than the feed velocity to gather the fabric at selected points across the width of the sewing machine in response to actuation of selected ones of the plurality of double acting fluid operated solenoids.

2. The shirring device of claim 1 wherein each shirring tool further comprises a flexible member.

3. The shirring device of claim 1 wherein each shirring tool is made from a piece of flexible spring steel.

4. The shirring device of claim 1 wherein each shirring tool includes a pad in contact with the fabric, the pad having a surface with a coefficient of friction that permits the pad to grip the fabric.

5. The shirring device of claim 1 wherein each shirring tool includes a rubber pad in contact with the fabric.

6. A shirring device for use with a sewing machine having a row of sewing needles arranged across a width of the sewing machine, the row of sewing needles carrying thread and being moved through a reciprocating cycle by a needle drive to sew a fabric being moved at a feed velocity beneath the plurality of needles, the shirring device comprising:

a support having a length extending across the width of the sewing machine, the support being mounted to the sewing machine on one side of and generally adjacent to the row of needles, the support including selectively lockable and releasable pivot joints at each end of the support for pivoting the support about a longitudinal axis of the support with respect to the sewing machine;

a plurality of solenoids mounted on the support at different locations along the length of the support, each of the solenoids being associated with and generally adjacent to at least one of the needles; and a plurality of shirring tools, each of the shirring tools being operatively attached to one of the plurality of solenoids and forming an included acute angle of attack with respect to the fabric, the plurality of shirring tools selectively contacting and moving the fabric at a velocity greater than the feed velocity to gather the fabric at selected points across the width of the sewing machine in response to actuation of selected ones of the plurality of solenoids, whereby pivoting the support changes the angle of attack and a size of the gather of the fabric.

7. A shirring device for use with a sewing machine having a row of sewing needles arranged across a width of the sewing machine, the row of sewing needles carrying thread and being moved through a reciprocating cycle by a needle drive to sew a fabric being moved at a feed velocity beneath the plurality of needles, the shirring device comprising:

a support having a length extending across the width of the sewing machine, the support being mounted to the sewing machine to locate one side of the support and generally adjacent to the row of needles, the support including an adjustment device for changing the distance between the row of needles and the support;

a plurality of solenoids mounted on the support at different locations along the length of the support, each of the solenoids being associated with and generally adjacent to at least one of the needles; and a plurality of shirring tools, each of the shirring tools being operatively attached to one of the plurality of solenoids, the plurality of shirring tools selectively contacting and moving the fabric at a velocity greater than the feed velocity to gather the fabric at selected points across the width of the sewing machine in response to actuation selected ones of the plurality of solenoids, whereby the movable support permits selective adjustment of the location of the gathers of the fabric with respect to the row of sewing needles.

8. The shirring device of claim 7 wherein the adjustment device comprises an adjusting screw for changing the distance between the support and the row of parallel sewing needles.

9. The shirring device of claim 7 wherein in the adjustment device comprises:

a first adjusting screw for moving the support toward the row of parallel sewing needles; and a second adjusting device for moving the support away from the row of parallel sewing needles.

10. A shirring device for use with a sewing machine having a plurality of sewing needles arranged across a width of the sewing machine, the plurality of sewing needles carrying thread and being moved through a reciprocating cycle by a needle drive to sew an upper material to a lower material being moved at a feed velocity beneath the plurality of needles, the shirring device comprising:

a plurality of double acting fluid operated solenoids mounted at different locations across the width of the sewing machine, each of the fluid operated solenoids including a cylinder having a bore extending longitudinally between opposite ends of the cylinder, and a piston slidingly disposed within the cylinder;

a plurality of valves, each of the valves being mounted on one of the plurality of solenoids for controlling fluid flow to the one of the plurality of solenoids;

a plurality of fluid conducting lines being connected between one of the plurality of valves and a source of fluid, each of the fluid conducting lines being of generally equal length for supplying fluid to the plurality of valves; and a plurality of shirring tools, each of the shirring tools being operatively attached to one end of a respective piston, the plurality of shirring tools selectively contacting and moving the fabric at a velocity greater than the feed velocity to gather the fabric at selected points across the width of the sewing machine in response to actuation of selected ones of the plurality of solenoids.

11. A method of shirring a fabric comprising the steps of:

moving the fabric at a feed velocity past a plurality of shirring tools and a plurality of reciprocating needles spaced a predetermined distance from the plurality of shirring tools;

selectively moving less than all of the plurality of shirring tools and portions of the fabric in contact with the less than all of the plurality of shirring tools toward the plurality of reciprocating needles at a shirring velocity greater than the feed velocity of the fabric to produce gathered portions of the fabric at selected points across a width of the fabric; and sewing the gathered portions of the fabric with the plurality of reciprocating needles to hold the gathered portions of the fabric together.

12. The method of claim 11 wherein the step of selectively moving less than all of the plurality of shirring tools further comprises the steps of:

selectively moving the less than all of the plurality of shirring tools from a starting position into contact with the portions of the fabric in response to the plurality of needles being at a predetermined point in a common reciprocating cycle;

moving the less than all of the plurality of shirring tools and the portions of the fabric toward the plurality of reciprocating needles at the shirring velocity, thereby producing gathered portions of the fabric at the selected points across the width of the fabric; and moving the less than all of the plurality of shirring tools away from the plurality of needles back to the starting position.

13. A method of shirring a fabric comprising the steps of:

moving the fabric at a feed velocity past a plurality of shirring tools and a plurality of reciprocating needles spaced a predetermined distance from the plurality of shirring tools;

moving less than all of the plurality of shirring tools and selected portions of the fabric toward the reciprocating needles at a shirring velocity greater than the feed velocity to produce gathered portions of the fabric at selected points across a width of the fabric;

moving the less than all of the plurality of shirring tools away from the plurality of reciprocating needles; and sewing the gathered portions of the fabric with the plurality of reciprocating needles to hold the gathered portions of the fabric together.

14. A method of shirring a fabric onto a backing material comprising the steps of:

moving the fabric and the backing material in a layered relationship at a feed velocity past a plurality of shirring tools and a plurality of reciprocating needles spaced a predetermined distance from the plurality of shirring tools;

moving less than all of the plurality of shirring tools and selected portions of the fabric with respect to the backing material and toward the reciprocating needles at a shirring velocity greater than the feed velocity of the backing material to produce gathered portions of the fabric on the backing material at selected points across a width of the fabric; and sewing the gathered portions of the fabric to the backing material with the plurality of reciprocating needles.

15. A method of shirring a fabric onto a backing material comprising the steps of:

moving the fabric and the backing material in a layered relationship at a feed velocity past a plurality of shirring tools and a plurality of reciprocating needles spaced a predetermined distance from the plurality of shirring tools;

selectively advancing less than all of the plurality shirring tools from a starting position into contact with portions of the fabric in response to the plurality of reciprocating needles being at a predetermined point in a common reciprocating cycle;

moving the less than all of the plurality of shirring tools and the portions of the fabric with respect to the backing material and toward the reciprocating needles at a shirring velocity greater than the feed velocity of the backing material, thereby producing gathered portions of the fabric at selected points across a width of the fabric;

retracting the less than all of the plurality of shirring tools away from the plurality of reciprocating needles back to the starting position; and sewing the gathered portions of the fabric to the backing material with the plurality of reciprocating needles.

16. An apparatus for shirring a fabric comprising:

a needle drive;

a plurality of sewing needles carrying thread operatively connected to the needle drive to simultaneously operate through reciprocating respective sewing cycles;

a plurality of shirring tools mounted adjacent the plurality of needles;

a fabric drive supporting the fabric and moving the fabric past the plurality of shirring tools and the plurality of needles; and a control responsive to the reciprocating cycle of the plurality of needles and operatively connected to the plurality of shirring tools for operating less than all of the plurality of shirring tools in response to the plurality of needles being at a predetermined point in the reciprocating cycle to gather, for sewing by the needles, portions of the fabric in a selected pattern at selected points across a width of the fabric.

17. The apparatus of claim 16 wherein the control further includes a memory for storing a shirring program comprising a set of instructions for operating the less than all of the plurality of shirring tools in response to the plurality of needles being at the predetermined point in the reciprocating cycle.

18. The apparatus of claim 17 wherein the control further includes memory for storing a plurality of shirring programs, the shirring programs comprising a different set of instructions for operating different combinations of the plurality of shirring tools in response to the reciprocating cycles of the plurality of needles to gather and sew portions of the fabric in different selected patterns at different selected points across a width of the fabric.

19. An apparatus for shirring fabric comprising:

a needle drive;

a plurality of sewing needles operatively connected to the needle drive for operating the plurality of sewing needles through reciprocating sewing cycles;

a plurality of shirring tools mounted adjacent the plurality of needles;

a fabric drive supporting the fabric and moving the fabric past the plurality of shearing tools and the plurality of needles; and control means operatively connected to the plurality of shirring tools for providing a shirring cycle comprising detecting occurrences of the reciprocating cycles of the plurality of needles, counting the occurrences of the reciprocating cycles, detecting a predetermined number of the reciprocating cycles, and operating less than all of the shirring tools in response to detecting the predetermined number of reciprocating cycles.

20. The apparatus of claim 19 wherein the shirring cycle executed by the control means further comprises detecting occurrences of the reciprocating cycles of the plurality of needles at a predetermined point in the reciprocating cycles.

21. A method of shirring a fabric comprising the steps of:

operating a plurality of sewing needles extending across a width of the fabric carrying thread through reciprocating cycles;

detecting occurrences of the reciprocating cycles of the plurality of needles;

counting the occurrences of the reciprocating cycles;

detecting a predetermined number of occurrences of the reciprocating cycles; and providing a plurality of shirring tools adjacent to the plurality of needles and operating less than all of the shirring tools in response to the detected predetermined number of occurrences of the reciprocating cycles of the plurality of sewing needles to gather portions of the fabric by each of the less than all of the shirring tools.

22. The method of claim 14 comprising the steps of:

selectively advancing, prior to producing the gathered portions of the fabric, the less than all of the plurality shirring tools from a starting position into contact with the portions of the fabric in response to the plurality of reciprocating needles being at a predetermined point in a common reciprocating cycle; and retracting, after producing the gathered portions of the fabric, the less than all of the plurality of shirring tools away from the plurality of reciprocating needles back to the starting position.

* * * * *

UNITED STATES PATENT AND TRADEMARK OFFICE

CERTIFICATE OF CORRECTION

PATENT NO. : 5,771,829

DATED : June 30, 1998

INVENTOR(S) : Wilbur A. Schebler, Louis H. Werner and John Enneking

It is certified that error appears in the above-indentified patent and that said Letters Patent is hereby corrected as shown below:

Column 16, line 59, "shearing tools" should read -- shirring tools --.

Signed and Sealed this

Twenty-seventh Day of October, 1998

*Attest:*

Bruce Lehman

BRUCE LEHMAN

*Attesting Officer*

*Commissioner of Patents and Trademarks*